US006112853A

United States Patent [19]

Beard

[11] Patent Number: 6,112,853

[45] **Date of Patent: *Sep. 5, 2000**

[54] FALL RESTRAINT SYSTEM AND METHOD USEFUL FOR ROOF INSPECTION

[75] Inventor: David W. Beard, Bloomington, Ill.

[73] Assignee: State Farm Mutual Automobile Insurance Co., Bloomington, Ill.

[ * ] Notice: This patent is subject to a terminal disclaimer.

[21] Appl. No.: 09/205,275

[22] Filed: Dec. 4, 1998

Related U.S. Application Data

[63] Continuation of application No. 08/729,216, Oct. 9, 1996, Pat. No. 5,875,867.

[51] Int. Cl.[7] ..... E04G 1/36

[52] U.S. Cl. ..... 182/45; 182/3

[58] Field of Search ..... 182/3, 8, 45, 36, 182/129

[56] References Cited

U.S. PATENT DOCUMENTS

| | | | |
|---|---|---|---|
| 286,519 | 10/1883 | Zerr | 182/6 |
| 2,530,450 | 11/1950 | Duffey | 182/121 |
| 3,237,717 | 3/1966 | Jackson . | |
| 3,598,200 | 8/1971 | Thompson | 182/8 |
| 5,137,112 | 8/1992 | Nichols | 182/3 |
| 5,282,597 | 2/1994 | Babcock | 182/45 |

*Primary Examiner*—Alvin Chin-Shue

*Attorney, Agent, or Firm*—Irah H. Donner; Hale and Dorr LLP

[57] ABSTRACT

A fall restraint system protects a worker while inspecting and/or repairing a roof of a building. The restraint system includes a ladder that is positioned against the building. A fall restraint device is removably connected to the ladder and contacts the roof. A cable support structure is connected to the fall restraint device, and a cable is attached to it. The cable extends from the cable support structure toward the peak of the roof, and from the peak toward the ground. The cable is adapted to be connected to a harness that is worn by the worker. The worker then uses the cable to inspect/repair the roof.

15 Claims, 4 Drawing Sheets

FALL RESTRAINT SYSTEM AND METHOD USEFUL FOR ROOF INSPECTION

RELATED APPLICATIONS

This application is a continuation application of U.S. application Ser. No. 08/729,216, filed Oct. 9, 1996, U.S. Pat. No. 5,875,867, issued Mar. 2, 1999, which is hereby incorporated by reference.

TECHNICAL FIELD

This invention relates to a fall restraint system, and, more specifically, to a system for preventing a worker from falling from the roof of a building during inspection or repair.

BACKGROUND ART

Fall restraint equipment is used to enhance safety and convenience to personnel climbing a sloped roof during construction or inspection for damage. The danger of falls from such structures has been recognized, and a number of federal, state and local regulations require a safety system to be used when working on a roof.

Various kinds of conventional fall restraint equipment are available. Examples include nailing support plates into the roof, erecting overhead cables, lines and/or support pieces, or attaching scaffolds and railings. These techniques/devices, generally used during the installation of a roof or roof related materials, are not intended to be used for inspection of finished roofs where affixation of the equipment to the roof may damage the roof or leave noticeable and potentially dangerous marks, blemishes, scratches and the like.

Moreover, such equipment is unsuitable for inspections because the equipment is typically heavy, expensive and time consuming for installation. Conventional equipment is additionally unsuitable for mounting to a finished roof as the equipment may destroy the water-tight integrity nature of the roof.

I am aware of no prior art devices that can restrain a roof climber without attaching the device to the structure with nails or other fasteners that require customization or conditioning of a standard rooftop. I furthermore am aware of no prior art devices that have the ability to simultaneously base or support a ladder against the roof. For example, U.S. Pat. No. 5,282,597 to Babcock relates to a safety line anchoring device with layered fastening straps nailed through the lower shingle, thus leaving the top shingle unpunctured. U.S. Pat. No. 5,287,944 to Woodyard relates to a roof mounted anchor used in a fall restraint system. The anchor uses wooden screw fasteners to mount the anchor to the roof top. Similarly, U.S. Pat. No. 5,361,558 to Thornton et. al. relates to a safety line anchor mounted on roof. The legs of the anchor are secured to the roof by lag screws. All of these prior art methods require screws to be inserted in the roof top to secure the anchoring device thereto, raising or causing significant problems as discussed above.

U.S. Pat. No. 4,450,935 to Gustavus and U.S. Pat. No. 4,695,023 to McCafferty both relate to platforms for use on a roof ladder. No mechanism disclosed therein is utilized with a fall restraint system, and neither of these patents relate to affixing or biasing regular ladders to the roof top while also providing a fall restraint system.

U.S. Pat. No. 5,036,949 to Crocker et. al. relates to a motion-stopping system for roof workers. The system uses bolts to threadedly engage in holes to grip the structural members by tightening the bolts. The system requires preconditioned areas of the roof for attachment with the gripping anchor.

I have realized that it is desirable to provide a fall protection or restraint system for use in climbing sloped, finished roofs and the like, without requiring conditioning of the roof top. I have also realized that such a fall restraint system is needed that does not require affixation to the roof using screws, bolts and the like that may cause damage thereto.

I have further determined that a fall restraint system is needed that prevents or restrains a roof top climber from falling while simultaneously biases or affixes a regular ladder to the structure so that the climber can descend from the roof top safely.

I have further discovered that it is desirable and beneficial to design a fall restraint system that is used in conjunction with ladders. More specifically, I have discovered that ladders may be adapted to be more securely affixed or attached to the structure.

I have further discovered a design for the fall restraint system that is convenient and portable.

SUMMARY OF THE INVENTION

Thus, a feature and advantage of the fall restraint system of my invention is in a device for use in climbing sloped roofs to effectively restrain or prevent the climber from sliding.

Another feature and advantage of the fall restraint system is that it is simple, safe and inexpensive in construction.

A further feature and advantage is in a device that is lightweight, portable, that can be assembled and disassembled quickly and easily and that can be transported in a compact form, such as in the trunk of an automobile.

Yet another feature and advantage of the fall restraint system is in a fall restraint device that does not require physical attachment by, for instance, nails or other fasteners to the building structure.

Another feature and advantage of the fall restraint system is in its use on finished roofs and the like, without requiring conditioning of the roof top.

Another feature and advantage is in its use in conjunction with ladders. More specifically, the fall restraint system adapts ladders to be more securely affixed or attached to the structure that must be climbed.

Another feature and advantage of the fall restraint system is in preventing or restraining a roof top climber from falling while simultaneously biasing or affixing a ladder to the structure so that the climber can descend from the roof top safely.

In accordance with the above features and advantages, a fall restraint system is provided for protection of a worker on a building roof. The system includes a resistance device adapted to rest on a roof surface. A cable support structure is secured to the resistance device. A cable is connected at a first end to the cable support structure, and includes a first portion extending upwardly from the cable support structure toward a peak of the roof and a second portion extending downwardly from the peak toward the ground and terminating at a second end. The second portion is adapted to connect to a harness secured to the worker. A weight hangs from the second end of the cable to hold the cable taut. Preferably, the weight is approximately 5 kg.

The resistance device includes a stabilizer device that contacts the surface of the roof and stabilizes the fall restraint system.

According to one embodiment of the present invention, a fall restraint system for protection of a harnessed worker on a building roof includes a ladder positioned against the building, and a fall restraint device, removably connected to the ladder and contacting the roof. The fall restraint system also includes a cable support structure connected to the fall restraint device, and a cable having a first portion with a first end and a second portion with a second end. The first end of the cable is connected to the cable support structure and includes a first portion extending upwardly from the cable support structure toward the peak of the roof, and the second portion extends downwardly from the peak toward the ground and terminates at the second end. At least one of the first and second portions are adapted to be connected to a harness secured to the worker. The fall restraint system also includes a weight hanging from the second end of the cable to hold the cable taut.

In another embodiment of the invention, a method of protecting a worker from falls from a building roof using a fall restraint system is provided. The method includes the steps of placing a ladder against the building, removably attaching a first section of the fall restraint device to the ladder, and placing a second section of the fall restraint device on the roof. The method also includes the steps of positioning the first portion of the cable attached to the cable support structure over the peak of the roof, positioning the second portion downwardly from the peak toward the ground, and attaching the harness worn by the worker to the cable. The method also includes the steps of climbing the ladder and climbing onto the roof, and inspecting the roof using the cable and the harness to prevent falling from the roof.

The above and other objects, feature advantages of the present invention, will become apparent from the following description and the claims taken in conjunction with the accompanying drawings.

BEST MODE FOR CARRYING OUT THE INVENTION

Figure 1:
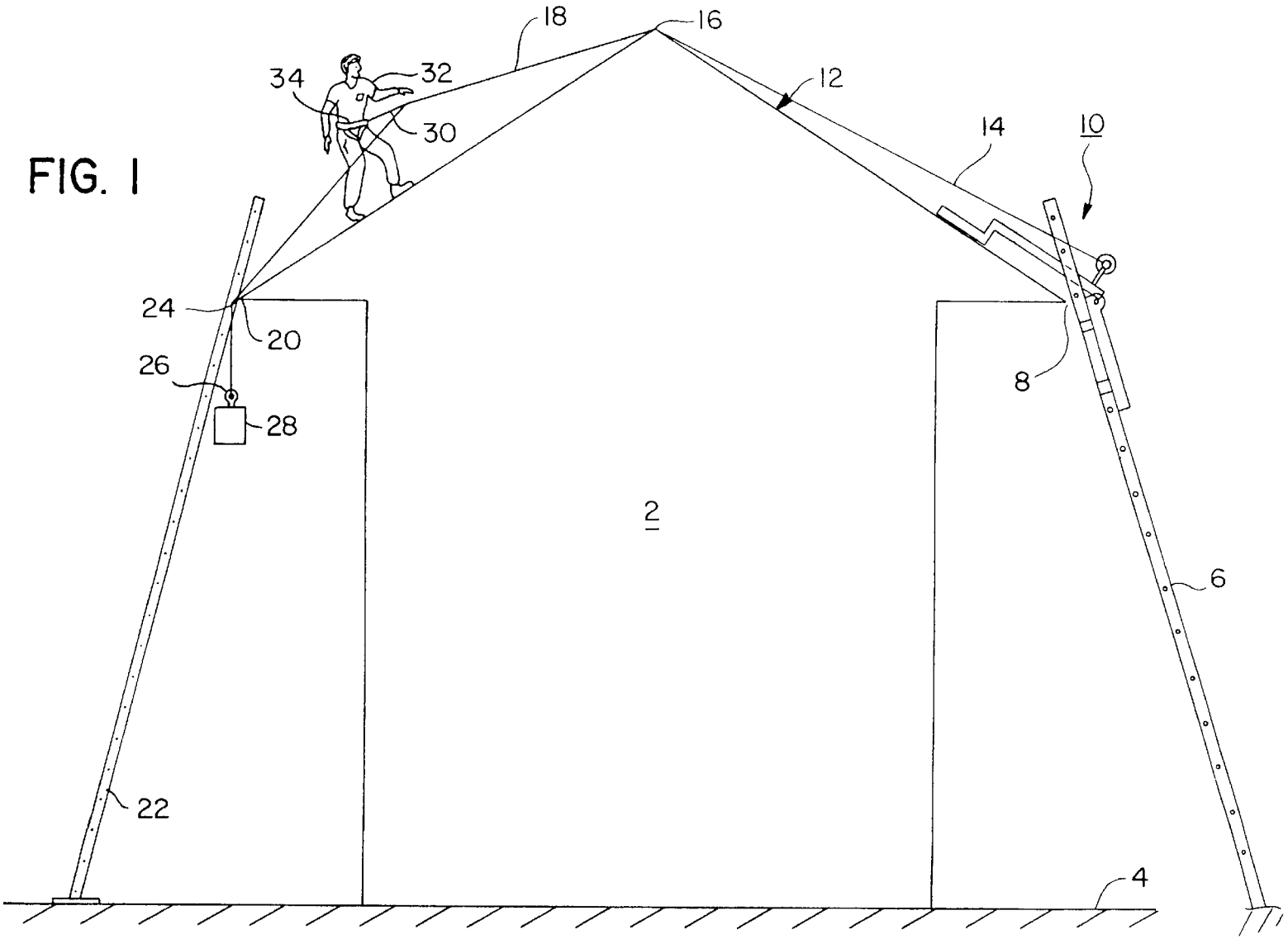
FIG. 1 depicts generally the fall restraint system according to the present invention.

In FIG. 1, a fall restraint system 10 in accordance with the invention is shown as installed or positioned on a building 2 having a roof 12 including a pair of opposing eaves 8, 20, and peak 16; other types of roofs are also applicable.

The fall restraint system 10 generally includes a cable support structure for affixation to cable sections or portions 14, 18, a weight 28 suspended from cable section or portion 18, and ladders 6, 22. Cable section 14 attached to fall restraint system 10 is positioned on the upper surface of the roof 12 near eave 8. Cable support portion 18 extends upwardly from fall restraint system 10 to peak 16 of roof 12, and downwardly toward the other side of roof 12, contacting and extending below eave 20 and terminating at end 26. Weight 28 is attached to cable section 18 at end 26. Weight 28 is preferably approximately 5 kg.

A worker 32 is shown wearing harness 34. Harness 34 is removably attached to cable 18 via a conventional rope adjuster 30. Rope adjuster 30 couples harness 34 to cable 18. Typically, worker 32 dons on the harness 34 on the ground, before climbing ladder 22. After climbing ladder 22 and reaching eave 20 in the vicinity of cable 18, worker 32 attaches harness 34 to cable 18 at rope adjuster 30. Worker 32 is then protected by fall restraint system 10 while inspecting roof 12.

One method of utilizing the fall restraint system is as follows. In operation, the fall restraint system 10 is positioned in accordance with the following procedure. Worker 32 places the lower end of ladder 6 onto ground 4, and also places the upper portion of ladder 6 against eave 8 of structure 2. Fall restraint system 10 can either be installed or fixed to ladder 6 after ladder 6 has been positioned against structure 2, or fall restraint system 10 can be positioned or fixed to ladder 6 before ladder 6 is positioned against eave 8 of structure 2.

Once fall restraint system 10 is in place or installed on ladder 6 and on roof 12 of structure 2, the first cable portion or section 14 is then attached to the fall restraint system 10. Alternatively, the cable portion 14 can also be affixed to fall restraint system 10 before fall restraint system 10 is placed on roof 12 of structure 2. Cable portion 14 is then extended over peak 16 of structure 2 and onto the other section of roof 12 as cable portion 18. Cable portion 18 then extends over ladder wrung 24 of ladder 22 which is positioned against eave 20 of structure 2. The end portion of cable 18 terminates at 26 which is attached to weight 28. Weight 28 is beneficially used to keep cable 14, 18 taut, as well as to simultaneously bias or secure ladders 6 and 22 against eaves 8 and 20, respectively. Worker 32 is connected to cable portion 18 via conventional rope adjustment mechanism 30 and harness 34.

In this manner, fall restraint system 10 is positioned on roof 12 of structure 2 securely, thereby allowing worker 32 to climb up roof 12 securely. In addition, fall restraint system 10 is designed not to interfere with roof 12 of structure 2, nor to require any special or customized adaptation of roof 12. Therefore, no damage results to roof 12 using the fall restraint system 10 described herein. In addition, fall restraint system 10 is compact and portable. As can be readily determined from FIG. 1, fall restraint system 10 is utilized in connection with at least one ladder, and perhaps two ladders, and is itself of a relatively compact nature. Thus, a ladder which is in any event an essential element of an inspection of a roof of a structure can be readily adapted to be used in conjunction with the fall restraint system 10 described herein. Therefore, fall restraint system 10 does not require an inordinate amount of additional materials or supplies to be carried and/or stored by the worker that is to inspect roof 12 of structure 2.

Figure 2:
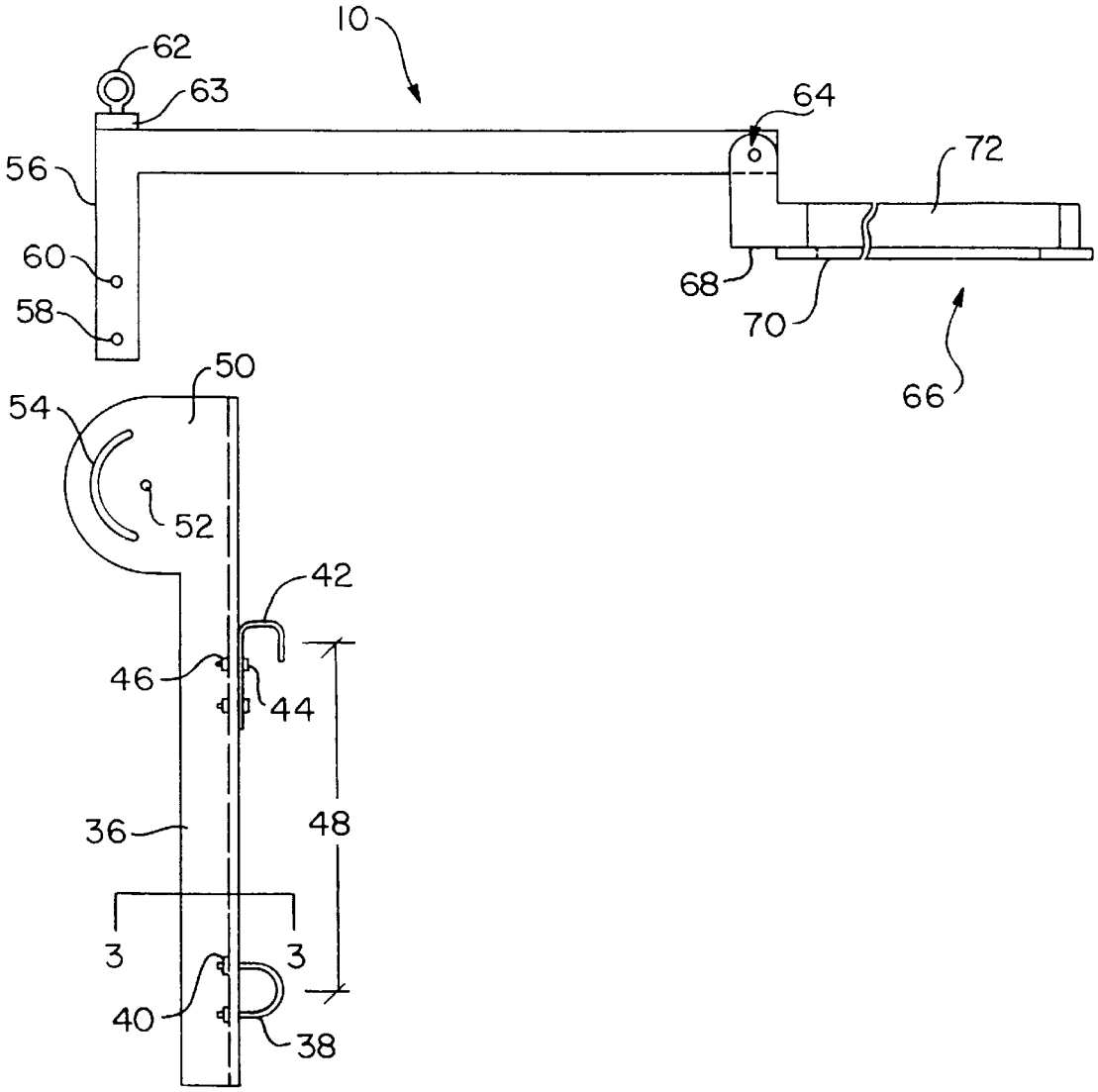
FIG. 2 is a side view of the fall restraint system of FIG. 1.

FIG. 2 is a side view of the fall restraint system 10 illustrated in FIG. 1, with the cable portions 14, 18 and structure 2 omitted for additional clarity. In FIG. 2, fall restraint system 10 includes ladder wrung brace 36 in rotatable connection with extension section 56. Extension section 56 is in turn rotatably connected to resistant device/section 66. Ladder wrung brace 36 functions as a brace for the fall restraint system 10 to a ladder which is then positioned near the roof of a structure. Resistant device 66 is used to assist in securing the fall restraint system 10 to the roof of the structure by creating a resistance upon placement on the roof. Extension section 56 provides the ability or spacing to permit ladder wrung brace 36 and resistance device 66 to simultaneously operate as described while still functioning as part of the same system. Extension section 56 may, of course, be omitted when the additional length is not needed.

Ladder wrung brace 36 includes U-bolt fastener 38 which is secured thereto via nuts 40. U-bolt fastener 38 is used to securely attach the ladder wrung brace 36 to a wrung of ladder 6. Ladder wrung brace 36 also includes hook 42 which is attached thereto via bolts 44 and nuts 46. Hook 42 is also used to secure ladder wrung brace 36 to another wrung of ladder 6. Hook 42 is typically used first by placing it over a wrung of ladder 6. Thereafter, U-bolt fastener 38 is then used to more securely attach ladder wrung brace 36 to ladder 6 via nuts 40. Hook 42 and U-bolt 38 are spaced apart by distance 48, which is generally the standard distance between ladder wrungs, i.e., approximately 12 inches in length.

Ladder wrung brace 36 further includes sector 50 that is machined to allow pivoting of fall restraint system 10 when positioned on roof 12, thereby providing the ability for ladder 6 to be positioned at a safe upright angle with respect to structure 2. Sector 50 includes pivot fulcrum 52 and pivot slot 54. Pivot fulcrum 52 engages with fulcrum receiver hole 58 of extension section 56 via standard methods/means, such as a screw inserted therethrough. Of course, other types of connection means are possible, and considered within the scope of fall restraint system 10. For example, a cotter pin type connection means could be used instead of a screw being inserted through pivot fulcrum 52 and fulcrum receiver hole 58.

Pivot slot 54 engages slot receiver hole 60 of extension section 56 via, for example, standard connection means. For example, a screw may be inserted through slot receiver hole 60 and pivot slot 54 that is movable within pivot slot 54. In this manner, extension section 56 is pivotally engaged with ladder wrung brace 36 to permit ladder 6 to be placed at as safe angle with respect to roof 12 of structure 2.

Extension section 56 includes eye bolt 62 connected to extension section 56 via, for example, segment 63. Extension section 56 is then pivotally connected to resistance device 66 via pinned joint pivot 64. Pinned joint pivot 64 may be, for example, a screw or cotter pin type pivot mechanism, or other standard pivot mechanism. Note that extension section 56 is "L" shaped. However, other shapes of extension section 56 are considered to be within the scope of fall restraint system 10. For example, extension section 56 may be shaped in an obtuse or in an acute angle or even a straight line. For the purposes of fall restraint system 10, however, extension section 56 has been shown to be particularly convenient in an "L" shape.

Resistance device 66 includes section 68 connected to section 72 with a resilient pad 70 to rest on roof surface 12 of structure 2. Resistance device 66 is also in an "L" shape. However, as discussed above, other shapes are considered within the scope of fall restraint system 10.

Figure 3:
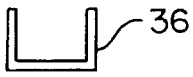
FIG. 3 is a sectional view of the ladder wrung brace taken along sectional lines 3—3 of FIG. 2.

FIG. 3 is a sectional view of the fall restraint system 10 illustrated in FIG. 2, along sectional lines 3—3. In FIG. 3, a sectional view of ladder wrung brace 36 is illustrated as being shaped in the form of a "U". The "U" shape of ladder wrung brace 36 permits attachment of U-bolt 38 and hook 42 without requiring U-bolt 38 or bolts 44 to be of excessive length for attachment thereto. The "U" shape also reduces the overall weight of fall restraint system 10, thereby increasing its portability.

Figure 4:
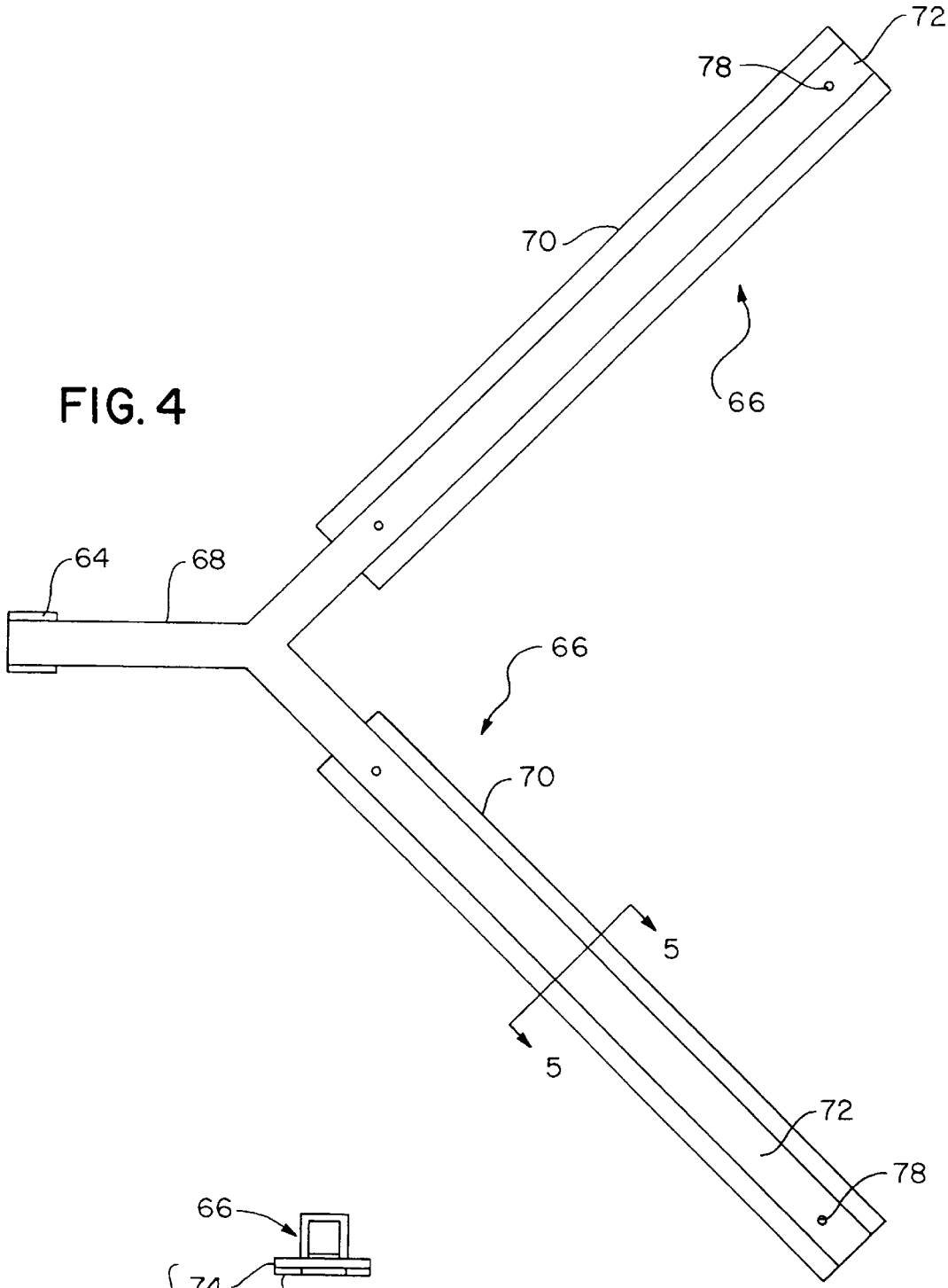
FIG. 4 is a top view of the resistance device illustrated in FIG. 2.

FIG. 4 is a top view of the resistance device 66 in the fall restraint system 10 illustrated in FIG. 2. In FIG. 4, resistance device 66 includes pivot joint 64 connected to segment 68. Segment 68 extends in a straight direction from pin pivot joint 64. Segment 68 is then bifurcated or extended into two separate sections 72 that extend in a "V" shape therefrom. The sections 72 that extend outward from segment 68 of resistance device 66 include resilient pads 70 connected on the bottom thereof via any standard connection means 78, such as a screw, cotter pin, and the like. Thus, in accordance with this design, resistance device 66 is able to be frictionally secured to the roof via the extended contact it has therewith. More specifically, the "V" shape of resistance device 66 provides greater support and temporary adherence of resistance device 66 to roof 12 of the structure 2.

Figure 5:
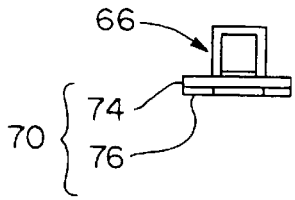
FIG. 5 is a sectional view of the resistance device in the fall restraint system illustrated in FIG. 3 taken along sectional lines 5—5.

FIG. 5 is a sectional view of the resistance device 66 in the fall restraint system illustrated in FIG. 3 along sectional lines 5—5. In FIG. 5, segment 66 includes resilient pad 70 attached to the bottom thereto. Resilient pad 70 includes an aluminum alloy backing plate 74 and a resilient material 76 on the bottom thereof. Segment 66 and backing plate 74 may be of any generally rigid material that is capable of withstanding the necessary force exerted when the worker on the roof uses the cable attached thereto for support. Accordingly, a metal alloy, a steel alloy, an aluminum alloy, a rigid plastic and/or other composite material are all considered within the scope of fall restraint system 10 described herein.

Figure 6:
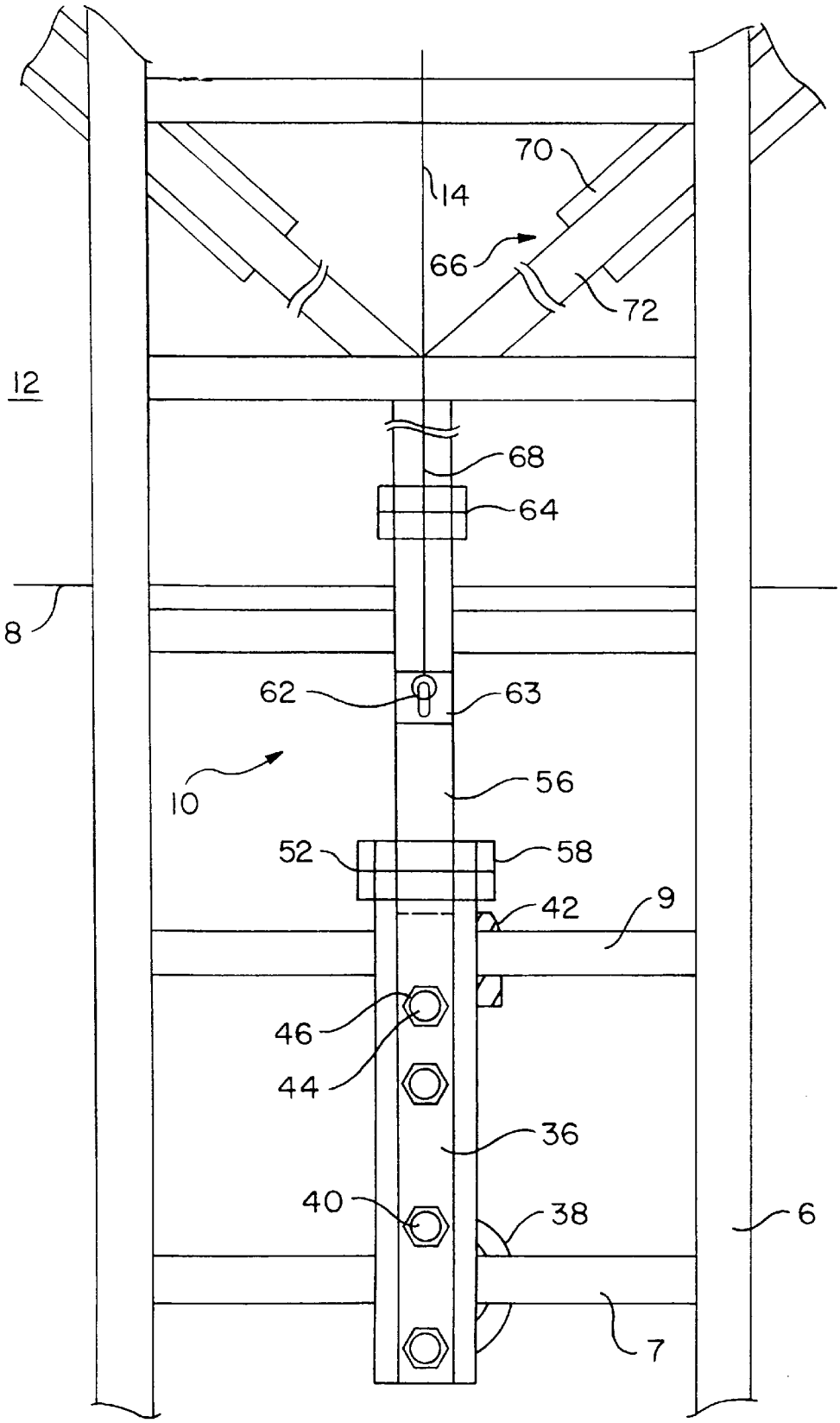
FIG. 6 is a front view of the fall restraint system with the resistance device secured to a ladder.

FIG. 6 is a front view of the fall restraint system 10 with ladder wrung brace 36 secured to ladder 6. In FIG. 6, ladder 6 is biased against the structure at eave 8. Ladder 6 includes wrungs 7 and 9. Wrung 7 is secured to ladder wrung brace 36 via eye bolt 38 and nuts 40. Ladder wrung brace 36 is also biased against or fixed to ladder wrung 9 via hook 42 and bolt 44 and nut 46. Of course, as indicated above, any standard type of connection can be used to affix hook 42 and eye bolt 38 to ladder wrung brace 36. Further, ladder wrung brace 36 may be secured to ladder 6 using any conventional means.

Ladder wrung brace 36 is then pivotally connected to extension section 56 via sector 50, pivot fulcrum 52 and slot 54 (not shown; see FIG. 2). Extension section 56 includes cable connection means or eye bolt 62 that is connected thereto via, for example, platform 63 that provides additional stability. Cable 14 is then connected to cable connection means 62 and it extends over roof 12. Resistance device 66 is then pivotally connected to extension section 56 via pivot joint 64. Section/legs 72 then extend outwardly in a "V" shape onto roof 12 and are in contact therewith via resilient pad 70.

In this manner, fall restraint system 10 is able to be removably secured to ladder 6 and be frictionally secured to roof 12 of structure 2 to ensure that cable 14 can be used by a worker that is inspecting the roof. That is, when the worker pulls on cable 18, 14 while on roof 12, the cable 14 will attempt to pull the ladder 6 and the resilient device 66 against roof 12, thereby insuring that cable 18, 14 is safely attached to fall restraint system 10. Further, in accordance with the design of fall restraint system 10, when the worker ascends roof 12, the worker pulls on cable 14 in a direction opposite to fall restraint system 10. Fall restraint system 10 then further biases ladder 6 against eave 8 of structure 2. Further, restraint device 66 is also further biased against roof 12, thereby further securing ladder 6 to structure 2.

It thus can be appreciated that the apparatus of the present invention offers many advantages over the prior art systems. The apparatus, made of the materials described herein, is lightweight and portable. The ladder(s) and fall restraint system can be contracted or expanded as necessary, and in its contracted state, requires very little storage room. The fall restraint system contacts the roof without requiring any alteration or modification to the roof. No fasteners are required. The fall restraint system further provides safe and effective restraint of a worker from falls.

Although a preferred embodiment of the invention has been described herein, other variations within the scope of the invention are possible. For example, the apparatus is equally applicable to other types of roofs where fall restraint is desired. The materials used to construct the apparatus may be varied according to weight, design, safety and other considerations. The "V" shaped brace design of the resistance device may be replaced with any other suitable designs, providing an advantageous cable attachment point above the roof so as to minimize contact with the roof, as well as damage resulting from such contact. The load bearing points on the roof may be relocated to other locations, and the fall restraint system may be modified with other suitable designs For example, the fall restraint system may be constructed without the use of the extension section between the ladder wrung brace and the resistance device. In this situation, the resistance device and the ladder wrung are directly pivotally connected to each other.

Although the present invention has been described and illustrated in detail, it is clearly understood the same by way of illustration in example only and is not to be taken by way of limitations, the spirit and scope of the invention being limited only by terms of the appended claims.

What is claimed is:

1. A restraint system for protection of a building roof worker, said restraint system comprising:

a building ascension device;

a portable fall restraint mechanism carried by said building ascension device;

a cable support structure connected to an extension section of said portable fall restraint mechanism; and a cable having a first end connected to said cable support structure, said cable having both a first section for extending upwardly from said cable support structure and a second section for extending downwardly on an opposite side of a roof, said second section terminating in a tensioning element for biasing the cable taut;

wherein at least one of the first and second sections of said cable is adapted to connect to a harness secured to the worker, and wherein the second section of the cable is positioned around at least one rune of said second ladder to bias said second ladder in a safe leaning position to enable the worker to ascend said second ladder safely.

2. A restraint system according to claim 1, wherein said building ascension device comprises a first ladder, and wherein said restraint system further comprises a second ladder positioned on a side opposite said first ladder, wherein the second section of the cable is accessible by the worker when the worker uses said second ladder.

3. A restraint system according to claim 2, wherein the second section of the cable positioned for use by the worker enables the worker to ascend said second ladder.

4. A restraint system according to claim 1, wherein said building ascension device comprises a first ladder, and wherein said restraint system further comprises a second ladder providing access to the second portion of the cable from the ground.

5. A restraint system according to claim 1, wherein said portable fall restraint mechanism includes a resilient pad positioned for sufficient contact for stabilization.

6. A restraint system according to claim 1, wherein said portable fall restraint mechanism comprises:

a ladder rung brace removably connected to a first ladder;

said extension section pivotally connected to said ladder rung brace; and a resistant device pivotally connected to said extension section.

7. A restraint system according to claim 6, wherein at least one of said ladder rung brace, said extension section and said resistant device comprises a material from one of metal alloy, fiberglass composite, steel alloy, aluminum alloy, and plastic composite.

8. A restraint system according to claim 6, wherein said ladder rung brace includes a hook for positioning over a first ladder rung, and an eye bolt securing said ladder rung brace to a second ladder rung.

9. A restraint system according to claim 6, wherein said ladder rung brace includes a pivot fulcrum and pivot slot, and wherein said extension section pivotally rotates about the pivot fulcrum and in the pivot slot of said ladder rung brace.

10. A restraint system according to claim 6, wherein said cable support structure is connected to said extension section connecting a first end of a first section of the cable to said portable fall restraint mechanism.

11. A restraint system according to claim 6, wherein said resistant device includes a frictionally securing resilient pad.

12. A restraint system according to claim 11, wherein said resistant device further includes a backing plate connected to said resilient pad.

13. A restraint system according to claim 6, wherein said resistant device includes:

at least two extension legs shaped in a "V" and extending from a pivotal connection of said extension section, and a frictionally securing resilient pad connected to each extension leg.

14. A restraint system according to claim 1, wherein the tensioning element comprises a weight having a mass of approximately 5 kg.

15. A restraint system for protection of a building roof worker, said restraint system comprising:

a building ascension device;

a portable fall restraint mechanism carried by said building ascension device, said portable fall restraint mechanism comprising a ladder rung brace removably connected to a first ladder, said extension section pivotally connected to said ladder rung brace, and a resistant device pivotally connected to said extension section;

a cable support structure connected to an extension section of said portable fall restraint mechanism; and a cable having a first end connected to said cable support structure, said cable having both a first section for extending upwardly from said cable support structure and a second section for extending downwardly on an opposite side of a roof, said second section terminating in a tensioning element for biasing the cable taut;

wherein at least one of the first and second sections of said cable is adapted to connect to a harness secured to the worker, and wherein said resistant device includes at least two extension legs shaped in a "V" and extending from a pivotal connection of said extension section, and a frictionally securing resilient pad connected to each extension leg.

* * * * *